US005131887A

United States Patent [19]

Traudt

[11] Patent Number: 5,131,887

[45] **Date of Patent: * Jul. 21, 1992**

[54] PRESSURE CONTROLLED FRESH AIR SUPPLY VENTILATION SYSTEM USING SOIL GAS PRESSURE AS A REFERENCE, AND METHOD OF USE

[75] Inventor: Jon E. Traudt, Omaha, Nebr.

[73] Assignee: Don E. Reiner, Omaha, Nebr. ; a part interest

[ * ] Notice: The portion of the term of this patent subsequent to Apr. 2, 2008 has been disclaimed.

[21] Appl. No.: 675,087

[22] Filed: Mar. 25, 1991

Related U.S. Application Data

[63] Continuation-in-part of Ser. No. 457,406, Dec. 27, 1989, Pat. No. 5,003,865.

[51] Int. Cl.[5] ..... F24F 11/04

[52] U.S. Cl. ..... 454/255; 454/236; 454/909

[58] Field of Search ..... 52/169.1, 169.5; 98/1.5, 31.5, 31.6, 33.1, 34.5, 34.6

[56] References Cited

U.S. PATENT DOCUMENTS

| | | | |
|---|---|---|---|
| 3,611,906 | 10/1971 | Lorenz | 98/33.1 |
| 4,620,398 | 11/1986 | Wallin | 98/42.02 X |
| 4,717,402 | 1/1988 | Lutterbach et al. | 98/33.1 X |
| 4,773,309 | 9/1988 | Walters | 98/31.6 |
| 4,781,107 | 11/1988 | Nilsson | 98/1.5 X |
| 4,843,786 | 7/1989 | Walkinshaw et al. | 98/31.5 X |
| 4,905,579 | 3/1990 | Dame | 98/1.5 |

FOREIGN PATENT DOCUMENTS

| | | | |
|---|---|---|---|
| 1110997 | 8/1984 | U.S.S.R. | 98/1.5 |

OTHER PUBLICATIONS

"Radon Reduction Techniques for Detached Houses", *Technical Guidance,* EPA/625/5-86/019, U.S. Environmental Protection Agency, Jun. 1986.

"Radon Reduction Techniques for Detached Houses", *Technical Guidance,* (Second Edition), EPA/625-/5-87/019, U.S. Environmental Protection Agency, Jan. 1988, pp. 153 and 154.

*Primary Examiner*—Harold Joyce

*Attorney, Agent, or Firm*—James D. Welch

[57] ABSTRACT

A ventilation system allows for a user adjustable minimum inlet fresh air volume inflow rate, a user adjustable minimum exhaust air volume outflow rate, for an enclosed space, and provides for automatic adjustment of the air volume flow rate(s) to maintain the air pressure inside the enclosed space at a user selected level which is measured in relation to the relatively constant soil gas pressure beneath the enclosed space, or pressure under the floor of the lowest occupied level, under which floor, soil gas is present.

21 Claims, 2 Drawing Sheets

PRESSURE CONTROLLED FRESH AIR SUPPLY VENTILATION SYSTEM USING SOIL GAS PRESSURE AS A REFERENCE, AND METHOD OF USE

This is a continuation-in-part of application Ser. No. 457,406, filed Dec. 27, 1989 U.S. Pat. No. 5,003,865.

TECHNICAL FIELD

The present invention relates to enclosed space, (such as that in a house or building), ventilation systems and their methods of use, and more particularly to air pressure controlled enclosed spaces and a ventilation system which utilizes the soil gas pressure below the enclosed space as a reference pressure, to which enclosed space inside air pressure is compared by the system during operation. The inlet fresh air volume inflow rate into an enclosed space is controlled by a fresh air supply device based upon an initial user set value of desired inlet fresh air volume inflow rate, which set level of inlet fresh air volume inflow rate is, under normal conditions, then adjusted by ventilation system action in response to changes in a signal derived by comparison of said soil gas and inside enclosed space air pressures, in a differential pressure monitoring sensor comparison device.

BACKGROUND

The quality of air in enclosed spaces such as houses and other buildings is subject in a recently released Environmental Protection Agency Report titled "EPA Report to Congress on Indoor Air Quality", released Aug. 4, 1989. In that report reference is made to the so called "Sick Building Syndrome" and a program of increased research and information dissemination regarding the dangers of poor indoor air quality is recommended. Health effects attributed to air contaminants accumulating in poorly ventilated houses and other buildings range from eye, ear, nose and throat irritation, to full scale respiratory and neurological diseases, genetic mutations and cancer. Contaminants such as radon, asbestos, tobacco smoke, formaldehyde, volatile organic compounds, chlorinated solvants, biological contaminants and pesticides etc., and the synergistic effects of multiple contaminants are cited as causes of health problems.

The report suggests that reducing the sources of contaminants is the most direct and dependable option in overcoming the problem, and that while air cleaning equipment can complement air quality improvement, there is no substitute for providing an adequate ventilating inlet fresh air volume inflow rate into an enclosed space.

In recent years, the high cost of energy has led many people to strive to make their houses and buildings more tightly sealed, hence, in combination with the use of insulation, more energy efficient. Said efforts have included sealing cracks and other air leaks in their houses or buildings to prevent heated or cooled air from escaping, and outside air which requires heating or cooling, from randomly entering at an excessive rate. In effect, such houses and buildings become, to various degrees, closed systems. In such structures the inside air replacement rate is often reduced to far below the American Association of Heating, Refrigeration and Air Conditioning Engineers recommended minimum fresh air inlet volume flow rate of 15 Cubic Feet per Minute (CFM) per inhabitant, or 35% enclosed space air change per hour, whichever is greater, (see ASHRAE Standard 62-1989). The result of an insufficient inlet fresh air volume flow rate into, and out of, such tight enclosed spaces is that contaminants accumulate inside same to dangerous health affecting levels. To emphasise this point, it is estimated by some health care researchers that presently two persons per hour, in the United States alone, contract lung cancer as a result of contact with radon in poorly ventilated houses and other buildings.

It now seems obvious that ventilation should be carefully controlled so that an adequate oxygen supply is assured, contaminants in the air are filtered out, and excess air leakage into and out of enclosed spaces is minimized.

Given that, aside from the potential health hazards, making houses and buildings more energy efficient is desirable, then it follows that a method which would provide a sufficient health maintaining inlet fresh air volume inflow rate ventilation to a tight structure would be of great benefit. A search of existing Patents shows that numerous inventors have realized this and have proposed systems, and methods of their use, which provide controlled ventilation to enclosed spaces such as houses and buildings. The various approaches basically utilize a means to cause air flow, such as a motor driven blower, to cause air to move into and stale air to move out of an enclosed space. The inlet fresh air volume inflow rate is typically, but not necessarily in the most basic schemes, controlled based upon signals developed by sensing air pressure differences between the inside and the outside of a house or building, from signals derived from sensed rates of air flows in various parts of a system; or by sensing the velocity of the wind outside the house or building.

The most basic schemes simply provide a large inlet fresh air volume inflow rate into a house or building sufficient to raise the air pressure inside the house or building to a large positive value with respect to that outside the house or building. In such a scheme the inlet fresh air volume inflow rate must be large enough to maintain the positive pressure difference no matter what active or passive exhaust air flows develop. As an example, operating a cloths dryer or fireplace will actively force exhaust air from a house, and opening a door to the outside of the house or building can passively increase exhaust air. The problem with such simple large positive pressure systems is that they are wasteful of energy. The large volume of air which is flowed into a house or building equipped with such a system must be heated or cooled at times. As very large inlet fresh air volume inflow rates are not necessary to keep contaminant concentration levels low enough for health maintenance reasons, there is no valid reason to provide them to a tight house or building. Inventors have noted this and responded. For instance, Lorenz, in U.S. Pat. No. 3,611,906 and Van Huis in U.S. Pat. No. 4,043,256 teach systems which sense inside and outside air pressure and from same develop signals which are used to control the amount of inlet fresh air volume flow rate through a house or building, based upon the difference in said signals. That is, the flow of air into and out of a house or building is modified as required, by use of inlet air or exhaust air fans, to dynamically keep the inside air pressure above that outside the house or building. The problem with such schemes is that outside air pressure is used as a reference, and because of quickly occurring large magnitude wind induced changes in outside air pressure near houses, buildings and other obstructions, that reference is not particularly constant. A Russian Patent to Slavin et al., No. SU-590-556 teaches a system which goes some distance toward overcoming this defect by sensing wind velocity and combining a wind velocity derived signal with an outside atmospheric pressure derived signal, which combined signal is used as a basis to control inlet fresh air volume inflow rates. The problem remains, however, that wind induced pressures can change very quickly and significantly and control systems tend to become unstable when a reference signal changes quickly and with significant magnitude. A Patent to Johannsen, U.S. Pat. No. 4,257,318 recognizes that a constant reference signal is necessary to assure stability in a control system, and Johannsen focuses on the use of a user set reference signal level to which are compared numerous air pressure representing signals, which air pressure representing signals are produced by sensors in various locations in air ducts in a house or building. The Johannsen approach selects the lowest such sensed air pressure representing signal and that signal is compared to the user set reference signal. Inlet fresh air volume inflow rate is controlled based upon the signal resulting from the comparison. The Johannsen invention also provides for adjustable dead bands in the comparison circuitry to enhance stability. The problem with the Johannsen system is that, just as in the most basic large positive pressure schemes, the selected reference signal has no definite relationship to any relevant reference pressure, hence, the inlet fresh air volume inflow rate can be unknowingly set to energy wasting levels which are higher than necessary to provide a healthy environment inside a house or building, over time. A Patent to Haines et al., U.S. Pat. No. 4,407,185 teaches the sensing of pressure in a plenum system and controlling fresh air volume flow rates so that said pressure is typically maintained at a negative value with respect to outside air pressure. As a result outside air flows into the plenum. The reference signal is, however, derived from outside air pressure by a sensor which is exposed to wind, and thus the reference signal can be rapidly and significantly changed by wind induced pressure fluctuations, as has already been noted. It is added that while retaining a negative pressure in a plenum is an acceptable way to draw air into same, keeping a negative pressure in a house or building, relative to outside air pressure, can lead to, for instance, outside air being drawn into the house or building down through a chimney, thereby blocking the exit of dangerous gasses which result from the burning of fuel. The results can be deadly. A Patent to Dean et al. teaches a system for use in hospitals. A fresh air volume flow rate controlling signal is derived from the difference between air pressure signals derived by sensors located in a hospital room and in the hall outside the hospital room. An air volume flow rate is set, based upon the difference in said signals, which is sufficient to keep a positive or negative pressure in the room with respect to the pressure in the hall. While the pressure in the hall of a hospital will be relatively more constant than that outside the hospital, it will still change when doors are opened or closed etc. The reference pressure is variable and may have frequent fluctuations of a significant magnitude due to wind induced pressures. Also, since air is forced from one portion of the hospital to another, portion of the hospital from which air is removed may develop an air pressure therein lower than soil gas pressure. This can induce soil gas under that portion of the hospital to enter that portion of the hospital and contaminate it.

It will be appreciated that the systems surveyed above provide inlet fresh air volume inflow rates which use reference signals which are simply set arbitrarily, or which are derived based upon references signals which are not relatively constant. As well, the basic approach is to provide inlet fresh air volume inflow rates which are sufficient to keep a significant pressure differential in place. In either case the inlet fresh air volume inflow rates provided will, over time, be in excess of what is actually needed to provide a "just adequate" ventilation, from a health maintenance perspective. A Patent to Wallin, U.S. Pat. No. 4,620,398 suggests a different approach and teaches that the soil gas pressure under a slab upon which is present an enclosed space should be monitored and compared to the air pressure inside the enclosed space. However, the teachings are that the difference in the indentified pressures should be used to control an air pump which forces air into the sub-slab location, thereby sweeping soil gas out from under the slab, but in the process changing the soil gas pressure. In "Radon Reduction Techniques for Detached Houses, Technical Guidance (Second Edition)", by D. Bruce Henschel, EPA Report No. EPA/625/5-87/019, Revised January 1988 it is mentioned, on page 154, that if a method for maintaining a consistent pressurization in the basement of a house, above that of the soil gas pressure, can be derived, it could turn out to be a potentially attractive approach where it can be applied. Reference in said publication is made to the possible use of soil gas as a stable reference, but it is noted that no system and method are disclosed in that publication for making said use of the soil gas pressure as a stable reference pressure.

A need exists for a ventilation control system which identifies and utilizes a relatively constant pressure reference which can be compared with indoor air pressure, so a signal can be derived, so that variation in the signal can be used to control the inlet fresh air volume inflow rate into, and stale air volume flow rate out of, an enclosed space such as a house or building. Additionally, a need exists for a ventilation control system which does not typically maintain an excessive positive or negative air pressure in an enclosed space, or part thereof, and which provides ventilation in the amount which is just necessary to provide an adequate health maintaining, ventilation inlet fresh air volume inflow rate into, and stale air volume flow rate out of, the enclosed space, so that adequate oxygen is supplied and indoor air contaminant concentrations are kept below dangerous levels.

DISCLOSURE OF THE INVENTION

The need identified in the Background discussion is met by the system and method of the present invention. The present invention identifies an approach to enclosed space (note houses and buildings will be used as examples of enclosed spaces throughout this disclosure), ventilation control which is new, novel, nonobvious and different from that taught in all prior art of which the inventor is aware. The present invention identifies the "soil gas pressure" beneath an enclosed space as a source of a relatively constant control system pressure reference signal, and teaches that inlet fresh air volume inflow rate into, and stale air flow rate out of, an enclosed space (eg. a house or building etc.), should be controlled such that the pressure inside an enclosed space, (or some aspect thereof), equipped with the new invention system, is typically kept essentially in balance with said soil gas pressure, rather than at some large positive, (or negative), level with respect thereto. Note however, it is not beyond the scope of the present invention to operate the present invention system with the enclosed space inside air pressure at a slightly positive or negative pressure with respect to the soil gas pressure. This is further discussed in the Detailed Description Section.

So that the discussion herein might be better understood, it is, at this point, noted that "Atmospheric" pressure outside houses or buildings averages 14.7 pounds per square inch at sea level and results from the weight of the air in Earth's atmosphere acting downward on the Earth's surface. Of course this value varies with changes in weather systems, and atmospheric pressures higher or lower than 14.7 pounds per square inch are common. Typically, however, atmospheric pressure changes slowly. "Air pressure" at or near any obstruction to moving air, such as houses or buildings, can change quickly and significantly as a result of air moving essentially parallel to the Earth's surface, which air movement is commonly termed wind. As noted in the Background Section, it is the quick and significant changes in local air pressure outside houses or buildings which make said outside air pressure less than optimum for use in deriving a reference signal for use in inlet fresh air volume inflow rate controlled ventilation systems.

Continuing, it will be appreciated that a major health endangering source of contamination in tight houses or buildings is radon gas which leaves rocks and/or ground soil beneath a house or building, and enters a house or building when the pressure inside the house or building is less than the soil gas pressure, which radon can and often does, accumulate in said house or building because of insufficient ventilation therein. Radon gas is a product of the disintegration of uranium in the soil, and it is continually produced and released to the atmosphere along with other gasses from the soil. When a blockage to said release, such as the presence of a house or building, is present, a pressure, the "soil gas pressure", is developed beneath the house or building. The present invention provides that the pressure inside a house or building should typically be controlled to match, or slightly exceed and oppose the pressure exerted by soil gas in the soil beneath a house or building, thereby neutralizing the tendency for soil gas to enter the house or building. It is also noted that over time, on the average, soil gas pressure is slightly greater than atmospheric pressure outside houses or buildings, hence, on the average, if the pressure inside a house or building is kept essentially at or slightly above that of the soil gas pressure beneath the house or building, the pressure inside the house or building will be slightly in excess of outside atmospheric pressure. The result is that air inside the house or building with the system of the present invention installed therein will have a tendency to leave the house or building as is the case with the large positive pressure, with respect to outside air pressure, systems identified in the Background discussion. While it is recognized that the average atmospheric pressure outside a house or building, over time, is lower than soil gas pressure, wind induces instances where a brief inversion in the relationship can intermittantly take place. In such cases the outside air pressure on the upwind side of a house or building can become greater than air pressure inside said house or building. The present invention system does not attempt to quickly respond to signals from an exterior sensor exposed to wind induced pressures and adjust air pressure inside a house or building in response, such as do many of the inventions which are discussed in the Background Section. A recommendation in the present approach to ventilation control is that the enclosed space, (eg. a house or building etc.), using the system and method be made as "tight" as is economically practical. That is, as many air leaks and other openings as are economically practical to seal, except for fireplaces and exhaust vents etc., are sealed to minimize the amount of air which can randomly enter or infiltrate the house or building when outside wind pressure momentarily exceeds the air pressure level maintained inside the house or building. New houses and buildings can be constructed so that essentially no cracks and other air leaks exist. In existing houses and buildings, however, varying levels of "tightness" are achieved from efforts to seal cracks and other air leaks. It is noted that often outside walls of an older house or building can be accessed and cracks and other air leaks therein can be filled, but cracks and air leaks in walls inside older houses and buildings are often impractical to access and fill. As a result, the term "tight" is to be interpreted to represent a spectrum of situations extending from low to high as regards existing air, and hence energy, leakage pathways in the shell of an enclosed space, (eg. a house or building etc.). To help with the understanding of the concept of a tight house or building one can consider that in a tight house or building the act of bringing in a minimum safe level of inlet fresh air volume inflow rate from outside for the number of occupants therein will typically cause the inside air pressure to be greater than the soil gas pressure. One reason tight structures are preferred in practicing the present invention, is that air entering the house or building with the system of the present invention installed therein, predominantly enters through a provided inlet fresh air system. Included in said inlet fresh air system will typically be located an air prefilter which serves to minimize the airbourne contaminants entering a house or building. Also, as discussed supra, it is within the scope of the present invention, but not essential thereto, to place check valves on all exhaust vents in the house or building to allow air to leave the house or building, but not enter, to aid with this effect.

In operation, a user will select a setting on a control panel which will cause a base amount of fresh air volume inflow rate, (eg. 15 CFM per occupant or 35% air change per hour), into the house or building via the inlet fresh air system. The setting, as alluded to infra, will typically, but not necessarily, be restricted to values which cause the air pressure inside a house or building to normally just equal or just slightly exceed the soil gas pressure. The system will also provide for automatically increased inlet fresh air volume inflow rates when, for instance, air is exhausted from the house or building as a result of the operation of appliances, (eg. clothes dryer, or a fireplace etc.). The increased inlet fresh air volume inflow rate will typically be controlled to be just sufficient to maintain essential equality of the air pressure inside the house or building with the soil gas pressure. Hence, the air pressure inside the house or building will typically be equal or slightly higher, with respect to a relatively constant reference pressure. It will be appreciated that the control system of the present invention will not be subjected to wind effected quickly changing and substantial, stability threatening, reference pressure levels, but will rather operate based upon a relatively constant reference pressure level representing signal, which relatively constant reference pressure level representing signal is directly related to the soil gas pressure. Note that a tight enclosed space, (eg. a house or building etc.), may also be an energy efficient house or building if proper insulation is provided. A tight house or building has less excess air leakage driven by wind and thermal means.

It should be noted that optimum practice of the present invention requires that essentially most air leaks, which air leaks can allow random entry of outside air or exit of inside air, into or out of an enclosed space, (eg. a house or building etc.), be sealed to provide a tight structure. There remain, however, open passive exhaust air paths in the form of vents through appliances and fireplaces and the like, in addition to cracks and air leaks which can not be sealed, such as minor air leaks around doors and windows. No special active exhaust vent is therefore necessary in the practice of the present invention, although it is not beyond the scope of the present invention to provide a separate active exhaust device such as a blower or air pump where inlet and outlet air flows require balancing. In addition, the use of air dampers or valves to control air volume flow rate are within the scope of the present invention.

Also, as alluded to infra, it is within the scope of the present invention, but not essential thereto, to equip the open exhaust air vents with check valves which allow air outflow but not air inflow. This can be important, when for instance, outside upwind air pressure momentarily exceeds soil gas pressure due to intermittant wind pressure, and therefore, typically, enclosed space, (eg. house or building etc.), inside air pressure. Air will, under said conditions, tend to naturally passively enter the enclosed space if openings exist in upwind areas of the enclosed space. It is preferred that said air enter through the provided inlet fresh air system wherein, as mentioned, will normally be placed an air prefilter, (eg. a high efficiency contamination removing air filter).

As well, the present invention provides that the inlet fresh air system may simply feed air into an existing cold air return of the heating and air conditioning system of an enclosed space, thereby making the system of the new invention relatively simple and economical to install. In an optional arrangement an inlet air duct will feed directly into an enclosed space. This will be particularly true when the present invention is applied to an enclosed space which does not have a cold air return, and in which it is not feasible to fashion one. It should then be understood that a minimum of new equipments and enclosed space structural modifications are required to practice the invention.

The new system, thus, provides ventilation to an enclosed space, (eg. a house or building etc.), which is adjustable by a user and which can be just sufficient to provide a healthy environment therein. The present invention does not require that inlet fresh air flowed into an enclosed space, which must be heated and cooled, exceed a volume inflow rate in excess of that which is just sufficient to provide said healthy environment. The present invention also identifies and utilizes a stable reference pressure without intentionally changing same during operation, that being soil gas pressure. This is in sharp contrast to the many inventions taught in prior Patents which sense the outside air pressure which outside air pressure is effected by wind, which systems hence, encounter control system instability problems because of wind induced fluctuations in pressure, or which teach that soil gas pressure should be intentionally modified. Problems which are inherent in prior systems as a result of attempting to track a nonstable reference signal, are eliminated in the present invention. It should also be noted that the soil gas pressure is typically greater than the atmospheric pressure. Soil gas pressure results when the outflow of radon and other gasses which emminate from the earth is restricted by an obstruction such as a house or building. A house or building typically impedes, but does not stop the flow of soil gas into and around the enclosed space. The difference in pressure between the soil gas under an enclosed space, and atmospheric pressure is typically small and relatively constant, even during windy days. Wind does not significantly affect soil gas pressure under a typical enclosed space, (eg. a house or building etc.), because to do so, wind would have to blow downward on all sides of the enclosed space simultaneously.

DETAILED DESCRIPTION

The average American house is not "tight", as that term applies to minimal air leakage, and as a result is very energy inefficient. Construction techniques leave numerous air leaks, openings and cracks through which air can randomly enter or leave depending on the magnitude and direction of driving forces such as wind. Typically door and window fittings, pipe penetrations, garage and roof attachments and imperfections in walls etc. provide a large total area of leakage through which air can and does pass, (e.g. hundreds of square inches per house on the average). Not only do such air leaks allow outside air to enter, which outside air must then normally be heated or cooled to provide comfort to those who inhabit the house, they also allow dust, pollen and numerous other outside air contaminants to enter at random locations in the shells of houses. The result, in combination with the entry of soil gas, containing radon gas, via cracks in a house foundation, can be a very unhealthy inside environment. Contaminants can accumulate, unnoticed, to dangerous concentration levels and cause serious health problems. Some dangerous air contaminants have a detectible odor but many have no odor, taste or color. The American Lung Association notes that many contaminant induced illnesses are blamed on flu germs, stress and other causes. In most American houses the levels of contaminants inside are reduced naturally only when wind conditions cause an adequate volume of outside air flow to enter, and stale air to leave the house via the cracks and other air leaks, and/or open doors and windows etc. However, such windy days do not occur based upon the need for contaminant removal from specific houses, and when they do occur they can cause a flow of fresh air volume through the house in excess of, or less than that, required to optimally remove accumulated contaminants. The inlet fresh air volume inflow rate which is in excess of the amount actually needed must sometimes be heated or cooled and is thus wasteful of energy. An inlet fresh air volume inflow rate less than required to remove indoor air contaminants is, of course, potentially costly because of increased health care expenses.

Figure 1:
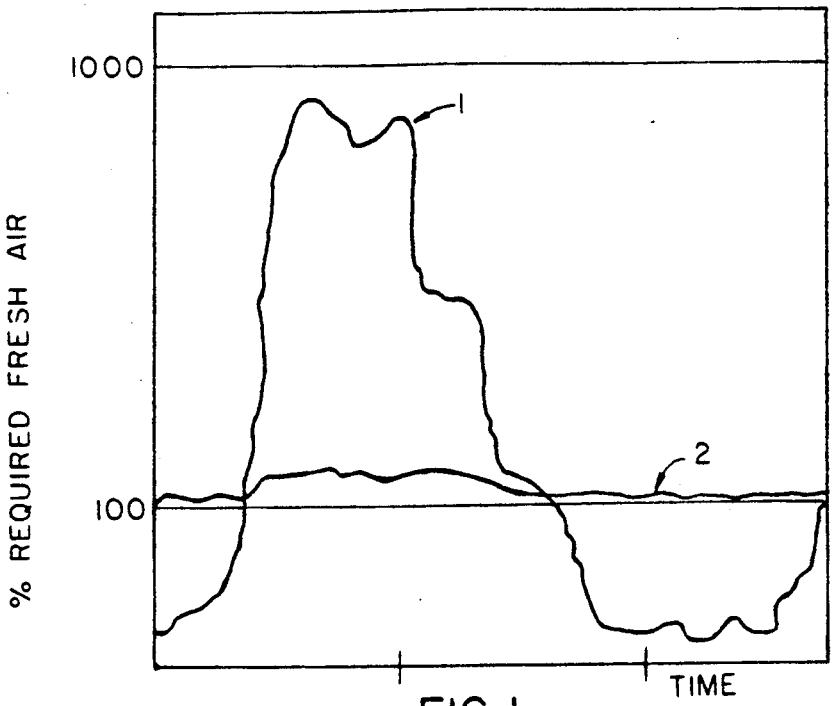
FIG. 1 is a graph showing, in graph line 1, a typical fresh air volume flow rate of air into a house or building which has air leaks therein which allow random entry and exit of air; and in graph line 2, a typical fresh air volume flow rate of air into a house in which the air leaks have been essentially all filled and in which ventilation air is provided by way of the present invention. Both graph lines are given as a percentage of that volume of fresh air volume flow rate just required to provide a healthy environment inside the house or building.

FIG. 1 is a graph which exemplifies the situation. Graph line 1 is a representation of house ventilation inlet fresh air volume inflow rate which varies in response to variations in wind speed, and which is shown as a percentage of that which is optimally required to make the inside air of a particular house healthy. Graph line 2 shows a similar, but greatly superior, result such as that provided by the present invention. It will be appreciated that graph line 2 supplies a just sufficient inlet fresh air volume inflow rate into a house to keep the inside air healthy and to supply make-up air to replace air removed from the house by kitchen exhaust systems, clothes dryers, etc. Only the amount of air, or slightly more than that amount, required to adequately supply oxygen and flush out contaminants at any given time is entered into the house, and only that amount of air must then be heated or cooled. Said basic inlet fresh air volume inflow rate can be set by a user of the present invention, and the system of the invention will then automatically vary said level of inlet fresh air volume inflow rate into the house to compensate for air which is exhausted from the house, as is further described in the following.

In recent years many people have become aware of the savings which can be achieved by reducing the air leakage in their houses, and hence, the amount of randomly entering air which must be heated and cooled. Many people have sought to make their houses more "air tight", and, hence, more energy efficient, by sealing such air leaks. The result, while probably reducing the amount of energy which must be expended to heat and cool such a house, can cause contaminants to accumulate to dangerously high, health endangering, levels because of a lack of adequate ventilation, even on windy days. That is, if most of the air leaks in a house are sealed, even strong winds can not enter the house at a high enough rate to adequately remove contaminants by ventilation. High levels of contaminants can and do, according to present data from the EPA, ASHRAE and the American Lung Association, cause health problems which can cost more to treat than is saved by the reduction in energy consumption as a result of sealing air leaks.

While it is desirable to reduce energy costs associated with operating a house, it is dangerous to simply make one's house tight by sealing air leaks. One should, in addition, provide a sufficient source of controlled ventilation inlet fresh air volume inflow rate to assure that contaminants are swept from the house as required to keep their concentrations below dangerous levels. The present invention provides a controlled source of ventilation inlet fresh air volume inflow rate which can be set to provide sufficient amounts of fresh air to maintain a healthy environment inside a house.

Figure 2:
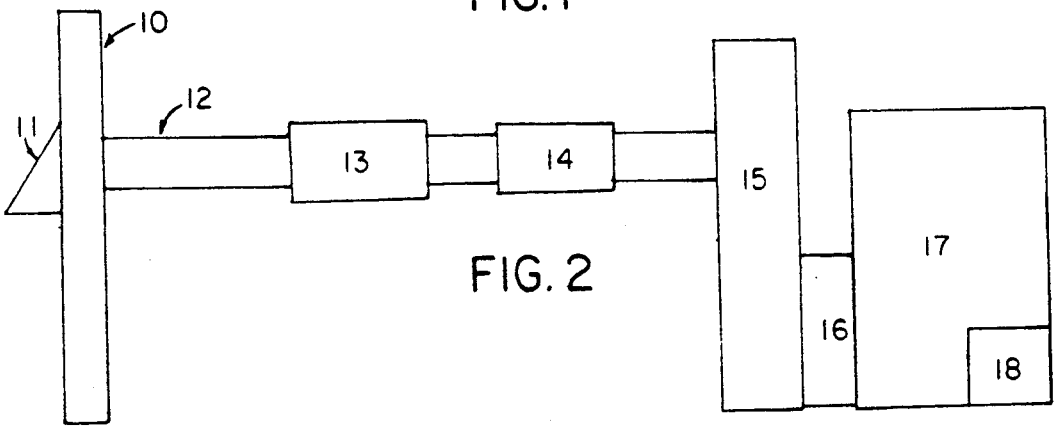
FIG. 2 shows, in block diagram form, the basic components typically present in the inlet fresh air supply and existing furnace and/or air conditioning system of an enclosed space, (e.g. a house or other building), when a forced air heating and/or air conditioning system is present.

The basic elements of the fresh air inlet portion of the present invention, configured in the preferred embodiment, are shown in FIG. 2. There is shown an inlet air duct system (12) which enters a house through an outside wall (10). A rain guard or hood (11) is shown protecting the duct system (12) where it enters the house, but said rain guard or hood does not obstruct the entry of air, nor is it a required element in the present invention. The inlet air duct system (12) has integrated therein an optional air prefilter (13) and a fresh air supply device such as an inlet air blower or air pump, (hereinafter referred to simply as inlet air blower), (14). Typically the duct system (12) will be installed so that it attaches to and opens into the cold air return system (15) of a house heating and/or air conditioning system so that incoming fresh from outside the enclosed space air can be heated or cooled before reaching the occupants. Alternate arrangements exist however, and will be discussed in reference to FIGS. 4 and 5 below. As well, an air filter, typically a high efficiency contaminant removing air filter, (16), (e.g. Honeywell Model F50), is placed between the cold air return (15) and the entrance to the furnace and/or air conditioning system (17). Said heating and/or air conditioning system (17) will contain a blower fan (18) which circulates heated or cooled air throughout the house, including the air entered through the fresh air inlet duct system as shown in FIG. 3.

In use the blower fan (18) in the furnace and air conditioning system (17) is usually set to operate at a low constant speed unless the air passing through said blower fan (18) is to be heated or cooled. In that case the blower fan (18) may operate at the speed which is standard when the present invention is not in place. The result, it will be appreciated, is that mixed fresh inlet air and recirculating inside air is continually filtered to remove airbourne contaminants prior to flowing throughout the system of the house or other building. However, when air leaks in the house are sealed, very little air will randomly enter at various unintended locations in the house. The amount will, of course, depend on how many air leaks remain. Inlet air volume inflow rate is thus, very nearly completely, in a very tight house, controlled by the fresh air supply device (14), which can be demonstrated as an inlet air blower in the inlet duct system (12).

The fresh air supply device (14) integrated into the present invention inlet fresh air supply system is set to operate at a speed which causes some desired base level of inlet fresh air volume inflow rate to be entered into the cold air return system (15) of the house heating and cooling system continuously, passing through the optional air filter, (16) typically a high efficiency contaminant removing air filter. This base level of inlet fresh air volume inflow rate is set by a user and can be varied within a certain range. The base level of inlet fresh air volume inflow is set by the occupants of a house so as to provide a healthy environment inside the house under normal conditions, (e.g. 15 CFM per occupant or 35% air change per hour or as otherwise necessary to minimize inside air contaminant levels). Under normal conditions fresh air will then enter the house by way of the invention inlet fresh air supply duct system (12), at location (11), and then be filtered by air prefilter (13) and then by the air filter (16), then flow through the house or other building by way of the furnace and/or air conditioning system (17), and then exit the house, typically, through a fireplace chimney, or other natural passive exhaust outlet. However, most houses today have appliances which cause air to be exited from a house when operated. For instance, the typical cloths dryer will exit approximately 100 CFM. A kitchen or bathroom exhaust fan will exit approximately 80 CFM. A Jenn-Aire(TM) Range will exit approximately 240 CFM during operation and a fireplace in which a fire is burning will cause approximately 30 to 120 CFM of air to exit a house.

Figure 3:
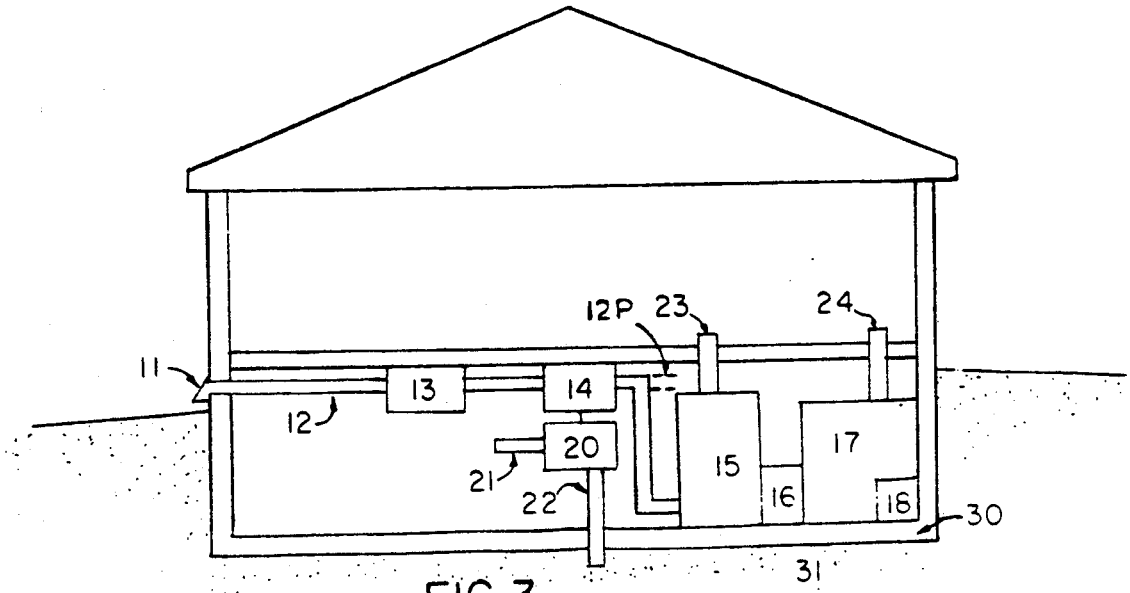
FIG. 3 shows, in block diagram form, the components shown in FIG. 2, but in a house setting, and additionally including representation of a pressure sensing device which senses the air pressure inside the house or building and the soil gas pressure beneath the house or building, and develops a signal based upon a comparison of said sensed pressures, which signal is used to control the fresh air volume flow rate in the ventilation system so as to maintain a chosen relationship between air pressure inside the house or building and the soil gas pressure.

Referring now to FIG. 3, it is seen that the present invention provides a device (20), (e.g. a pressure difference or pressure differential monitoring sensor such as Dwyer Instruments Model No. 3000-60PA), into which tubes (21) and (22), or equivalent pressure location access providing means, are placed. The open end of tube (21) or equivalent is typically, but not necessarily, placed in the basement of the house and the open end of tube (22) or equivalent is usually placed through a hole in the foundation (30), (note the term "foundation" can refer to a floor of an enclosed space under which floor soil gas is present), of the house or other building at which position it senses the soil gas pressure. Said hole is then sealed so that the tube (22) or equivalent is tightly gripped and so that soil gas can not escape around the outside of said tube (22) or equivalent. Also shown are a representation of normal house cold air return system elements (15) and (23) and a representation of normal house heated or cooled air circulation elements (24). The preferred embodiment of the present invention typically makes use of said commonly existing elements, thereby making the present invention economical to practice. The soil beneath the house, which provides the soil gas pressure which is sensed by the open end of tube (22) is identified by the numeral (31). Note also that fresh air supply device (14) can feed a duct (12P) (shown in dotted lines), which opens directly into the enclosed space in addition to, or in place of the duct which attaches to and opens into the cold air return (15).

The present invention uses the soil gas pressure as a relatively constant, approximate average atmospheric pressure representing, (soil gas pressure is actually normally slightly above atmospheric pressure), value to which the inside air pressure sensed by the open end of tube (21) or equivalent is compared. The pressure difference or pressure differential monitoring sensor (20) typically produces a signal which is proportional to the difference of the two identified sensed pressures. Said signal is used to control the rate at which inlet fresh air supply device (14) operates. During normal conditions the inlet fresh air supply device (14) will operate to cause the inside air pressure to be equal to, or just in excess of, the soil gas pressure. As the pressure inside the house decreases because of the operation of an appliance exhaust blower, etc., the inlet fresh air supply device (14) in the invention inlet air duct system (12) is caused to alter operations so as to cause a greater volume of air to enter the house and thereby cause the inside pressure to again be equal to, or just in excess of, the soil gas pressure. A change in inlet fresh air volume inflow rate into a house or building can be achieved in a fresh air supply device by changing the speed of a blower, the pitch of fan blades, the diversion of air flow or any equivalent means. As this pressure relationship is kept constant by the action of the control system, it will be appreciated that air pressure inside the house or building, can be maintained at a level equal to or greater than, soil gas pressure, (except possibly transitively before the system can react), and hence, very little soil gas, and the randon it contains will enter the house or other building equipped with the system. Also note that during the operation of the fresh air supply device (eg. an inlet air blower) (14), the heating and air conditioning blower fan (18) may continue to circulate filtered air within and thoughout the house. If the incoming air requires heating or cooling, said blower fan (18) may operate at a higher speed if desired by a user, and if not, at a slower speed. The pressure difference or pressure differential monitoring sensor (20) provides a signal to inlet fresh air supply device (14) causing it to speed up or slow down as required to maintain indoor air pressure within a range set by the user.

It will be appreciated that the present invention uses a relatively stable reference pressure, (eg. soil gas pressure). As such the control system is not subject to destabilizing significant, quick changes in reference signals as are commonly experienced by control systems which are exposed to the wind. Also, as the present invention system typically acts to supply just sufficient air to keep inside air pressure equal to, or just in excess of, soil gas pressure, there are no periods of time when excess and unnecessarily large volumes of incoming fresh air are required to be heated or cooled. Again, as the soil gas pressure is the reference, and inside air pressure is set equal to, or just in excess of same, very little soil gas containing randon can enter the house when the invention system is operated in a typical manner.

It is important that while the foregoing describes the invention as it will typically operate, the possibility exists that a user could set the minimum base inlet fresh air volume inflow rate so that the inside air pressure is less than the soil gas pressure, and hence, possibly very nearly equal to average outside atmospheric pressure. This follows as normally the outside atmospheric pressure is lower than soil gas pressure under a house or building. While such operation of the invention would not be typical, in leaky houses it might be optimum in that an inlet fresh air volume inflow rate lower than that necessary to keep the inside air pressure equal to, or just in excess of, the soil gas pressure is not required to provide a healthy environment inside the house. Tightly sealing some houses is prohibitively expensive. While random gas can enter a house when the invention is operated as such, because the pressure therein is less than the soil gas pressure, the inlet fresh air volume inflow rate might be sufficient to significantly dilute any entering randon and prevent its accumulation to dangerous concentration levels. The lower inlet fresh air volume inflow rate would translate into greater energy savings as less outside air would have to be heated or cooled, and more existing, already heated or cooled, inside air may be simply recirculated for longer periods of time. It will be understood then, that the pressure difference or pressure differential monitoring sensor (20) along with other elements of the present invention can provide a basic user selected inlet fresh air volume inflow rate when the inside air pressure is less that the soil gas pressure, and prevent indoor air pressure from becoming significantly lower than atmospheric pressure. The control system range of adjustment can accommodate such operation.

It is also mentioned that in some houses or buildings there are lower enclosed spaces which are not occupied more than a few hours each month. In these houses or buildings, air is preferably brought into the occupied area, thereby forcing stale air down into unoccupied areas. As discussed more below, the reference pressure can be the air pressure in the lower unoccupied enclosed spaces into which soil gas is allowed to flow.

As an added feature, some houses may include a signal controlled active air exhaust device, 36, which serves to cause air to leave a house. Such would typically be used in a house or building which is so tight that bringing in the minimum desired inlet fresh air volume inflow rate would create more inside air pressure than desired by the user, and/or when a heat recovery system is used. Note, however, that in many cases a separate active exhaust blower will not be added to a house or building as the user can simply adjust the base level of inlet fresh air volume inflow rate provided by inlet fresh air supply device (14) to provide the operation of the invention system at a desired fresh inlet air volume inflow rate, with stale air naturally exiting by way of the fireplace chimney, leaky exhaust vent, damper, air leaks in the foundation etc.

As alluded to earlier, soil gas pressure is relatively stable and is normally slightly higher than average outside atmospheric pressure, from which it typically differs by a relatively constant value. As a result, typical operation of the invention system will naturally lead to inside air pressure being higher than outside air pressure. As a result air will tend to naturally and passively flow out of all open house exhaust vents. It can happen, however, that wind can intermittantly cause the outside upwind air pressure to rise above the inside air pressure, and an inverted air flow situation would then occur in which air flows passively into the house through the open exhaust vents. For this reason, it is within the scope of the present invention, to place check valves to open exhaust vents such that air can flow out of the exhaust vents, but not enter. Such an inversion of air pressure as identified would then cause the inside air pressure to rise passively as a result of air flow into the house through the inlet air duct system (12), (and any remaining air leaks), only. When the wind subsides and the outside wind induced air pressure again becomes less than the inside air pressure, the invention will, of course, allow air to passively leave the house and the normal operation of the invention system, as described above, will resume. Thus, even in situations in which the upwind exterior air pressure against the house or building exceeds the inside air pressure, if check valves are installed as described and most air leaks have been sealed, air will enter by way of the fresh air inlet air duct supply system (12) and be subject to the air filtering and temperature adjusting process before being circulated in the house by the heating and/or and air conditioning system (17).

Figure 4:
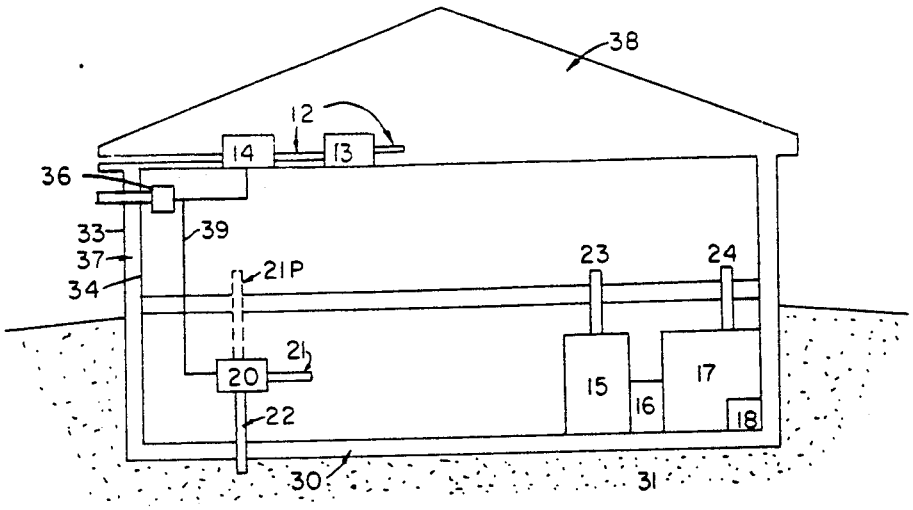
FIG. 4 shows, in block diagram form, the components shown in FIG. 3 in an enclosed space, but with the fresh air prefilter and fresh air supply device oriented to supply fresh air directly to the enclosed space inside a house, rather than to the cold air return of the heating and/or air conditioning system.

Turning now to FIG. 4, a modified version of the present invention is shown. As before, the enclosed space is demonstrated as a house. A heating and/or air conditioning system (17) with blower fan (18) is shown as present as are cold air return (23) and (15), air circulation element (24) and an air filter (16). The presure difference or pressure differential monitoring sensor (20), with tubes (21) and (22) are again present as well. However, also shown, in dotted lines is a tube (21P). this is to show that the air pressure inside an enclosed space can be monitored at various locations in the enclosed space. The major difference, however, between the embodiment shown in FIG. 3 and the shown in FIG. 4 is the location of the air prefilter (13), fresh air supply device (14) and common duct system (12). Note that entering fresh air is not entered into the cold air return (23) and (15), but rather is fed directly into the space in what would be the attic (38) of the represented house. This arrangement might be of benefit when a consideration is keeping insulation in the attic dry during cold weather when moisture condenses. When insulation becomes wet then mold, mildew, bacteria and fungi can grow and wood can rot etc. The identified flow of fresh air serves to diminish such effects. Also note that in older houses it is often easy to access outside walls (33) and fill air leaks therein, but the same is not always true with respect to air leaks in the inside walls (34). Fresh air entering the attic (38) can then follow the space (37) between said inner (34) and outer (33) walls and enter the enclosed space through air leaks in the inner walls (34). It shold be recognized that entering fresh air into the attic provides it access to heat which naturally rises, and to passive solar heating prior to its flowing into lower levels of the house or other building. This allows use heat which would otherwise be lost. Note that FIG. 4 shows the presence of a signal carrying wire (39) between pressure difference or pressure differential monitoring sensor (20) and fresh air supply device (14). Said wire (39) could be replaced with a radio control device, or power line carrier system etc., including a user who observes a meter and physically adjusts a control.

Figure 5:
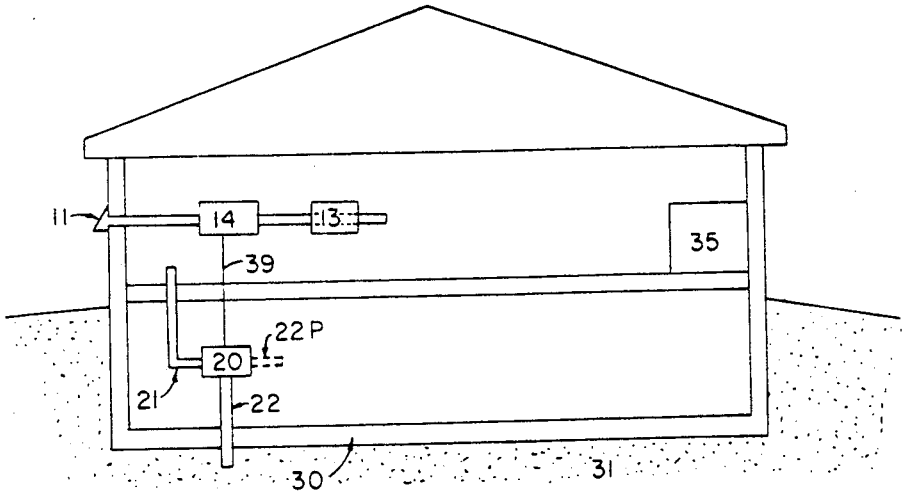
FIG. 5 shows, in block diagram form, the present invention as used in enclosed spaces which do not contain heating and/or air conditioning systems with cold air return systems. Note the reference pressure is shown as sensed at the level of the soil, or alternatively an enclosed, but seldom used space into which soil gas is allowed to enter.
Figure 6:
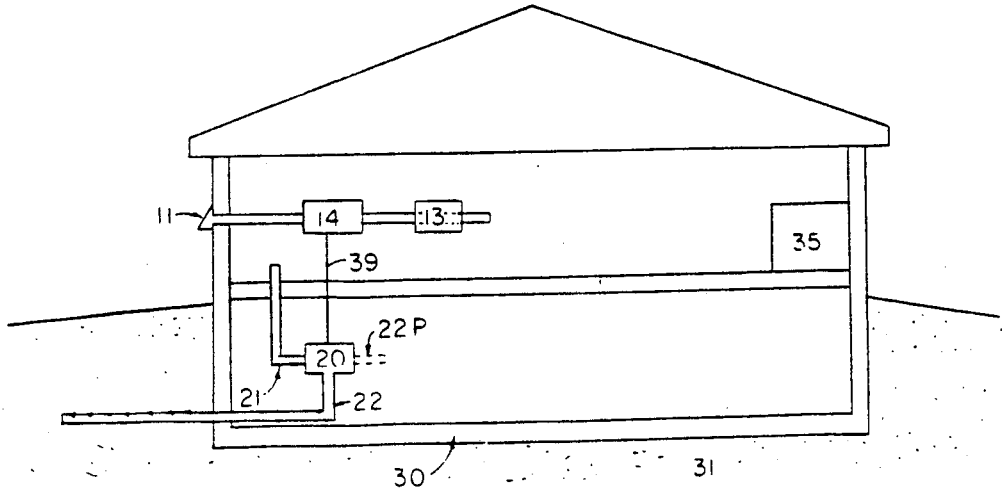
FIG. 6 shows the invention as shown in FIG. 5, but with the soil gas pressure sensed at a location horizontally displaced from the enclosed space, the sensing being accomplished by a pipe in which are located perforations.

FIG. 5 shows another variation of the basic invention. Note that the heating and/or air conditioner system (35) does not have an associated cold air return and might be thought of as a fireplace, a radiant heat source or a window air conditioner. The absence of an existing air distribution system and/or a cold air return arrangement is typical of many houses in the Eastern part of the United States. FIG. 5 shows the air prefilter (13), fresh air supply device (14) and attaching common duct (12), as well as the pressure difference or pressure differential monitoring sensor (20) are present. Also present are the tubes (21), (22) and (22P). A signal wire connects pressure difference or pressure differential monitoring sensor (20) and fresh air supply device (14). FIG. 5 shows that fresh air is entered into the first floor space of the house, and for demonstration purposes the heating and/or air conditioning system is shown as present on the same level of the house. The system operates much as described with respect to FIG. 4, except that the fresh air enters the first floor space rather than the attic (38). It is mentioned that as all occupants will probably be on the level of the enclosed space on which is the heating and/or air conditioning system, sensor tube (22P) could sense air pressure in a low level of the enclosed space should soil gas be allowed to accumulate therein. The air prefilter (13) is also shown with dotted lines therethrough. This is to indicate that, in some cases, it might be eliminated or bypassed.

FIGS. 3, 4, 5 and 6 serve to show that many variations of system component arrangement are possible within the scope fo the present invention. As a further embodiment of the basic invention it is taught that a user could fashion a cold air return in a house which did not have one, or could even configure the system so that fresh air entered at multiple locations. For instance, common duct (12) could be installed to provide fresh air via the attic, and/or the first floor, and/or the basement, and/or the cold air return if one is present or configured in a house. Additionally, multiple fresh air supply devices (14) and air prefilters (13) could be present and fed signals from one or more difference or differential pressure monitor sensor comparison device(s) (20). It is also within the scope of the present invention to simultaneously provide multiple enclosed area air pressure sensor tubes (21), (21P) etc. and to provide a system which monitors and selects a certain such element as the input to the difference or differential pressure monitoring sensor (20). Another variation of the invention would delete the air prefilter (13) from the common duct (12) with the fresh air supply device (14). The result could be used in an enclosed space with or without a heating and/or air conditioning system (17) or (35), to maintain the pressure inside the enclosed space as desired. It is also to be understood that sensor tube (22P) might sense the air pressur at a level of an enclosed space below the floor of the occupied levels. The term "soil gas pressure" is therefore to be understood to include air pressure in a portion of an enclosed space below the floor of occupied levels into which soil gas is allowed to enter and accumulate. It is important to emphasise that the term "tight", as used in this disclosure, is a relative term, and relates to the optimum operating condition of the system of the present invention. A tight house is defined as one in which the act of bringing in a minimum of outside air for the number of occupants will cause the air pressure inside the house to be equal to or greater than, the soil gas pressure. The term "tight" shall not be taken to represent any specific level of sealed air leaks or cracks or remaining open air leaks or cracks, as the term is used herein and specifically as used in the Claims. New homes can be constructed to be very tight. Some older homes can not, however, with reasonable expense, be tightly sealed. Also, it is mentioned that the fresh air supply device was referred to as an inlet air blower at times. Such reference was an example, not a limitation. As well, the pressure difference monitoring sensor was also termed a pressure differential monitoring sensor. There is no distinction meant by the dual reference. Another point which should be made is that fresh air, as referred to in this disclosure typically is air which is entered into an enclosed space from outside said enclosed space, and can be termed, in the alternative, outside air. Yet another point is that the word "foundation" should be interpreted to include any floor or other barrier below an occupied portion of an enclosed space, and not just a concrete slab directly atop of soil. In addition, the soil gas pressure can be measured directly below an enclosed space, or below an enclosed space at some distance horizontally removed therefrom and the sensing point need not be under an enclosed space foundation per se. For instance, a monitoring of soil gas pressure under a foundation can be approximated by pipe(s) with perforations therein, which pipe(s) extend horizontally from an enclosed space, (see FIG. 6). Said pipe(s) need not be under any specific foundation to monitor a soil gas pressure which approximates the soil gas pressure under a foundation of an enclosed space. The Claims are to be interpreted to include such an approach to monitoring soil gas pressure under a foundation of an enclosed space. In particular, this means that the soil gas pressure beneath a foundation of an enclosed space can be approximately monitored by sensors placed on a level in a horizontal plane with an enclosed space. Also, the term air leaks as used herein, is to be considered to include any crack, gap or other hole etc. between an enclosed space and the environment outside or under the enclosed space. Another term which requires clarification is "duct". A "duct" is to include any point of outside air entry into an enclosed space and is not limited to the definition given that term generally in heating and/or airconditioning systems. For instance, if a device causes air to flow from an attic into a first floor of an enclosed space, and outside air enters through an opening in the outside wall of the attic, said opening is a "duct" within the meaning given thereto, herein. The Claims are to be interpreted to include the above system modifications and terminology definitions.

It is also mentioned that the typical pressure difference between air pressure inside an enclosed space, and soil gas pressure, sensed by the pressure difference or pressure differential monitoring sensor is on the order of 0.01 inches of water column.

Proper utilization of the present invention then provides an energy efficient, healthy enclosed space for occupants. The energy efficiency will, however, be be dependent upon how many air leaks are sealed, (i.e. the "tightness" of the enclosed space, and of the presence of adequate insulation, in addition to the benefits provided by the invention system and method of use.

Finally, while a house was used as an example of an enclosed space in the foregoing, any other building can be fitted with the present invention.

Having hereby disclosed the subject matter of this invention, it should be obvious that many modifications and substitutions and variations of the present invention are possible in light of the teachings. It is therefore to be understood that the invention may be practiced other than as specifically described, and should be limited in breadth and scope only by the claims.

I claim:

1. A ventilation system for use in an enclosed space, which enclosed space is equipped with a heating and/or air conditioning system comprised of a cold air return, a blower fan and an air filter; which ventilation system comprises, in combination with the heating and/or air conditioning system, a series combination of an air prefilter and fresh air supply device, which air prefilter and fresh air supply device are attached to one another by way of a common duct, which common duct, at one end thereof, has access to the atmosphere outside the enclosed space, and which common duct, at the other end thereof, attaches to, and opens into the cold air return of the heating and/or air conditioning system of the enclosed space; which enclosed space heating and/or air conditioning system is fashioned such that essentially all air entering the cold air return passes through the air filter and is caused by the blower fan of the heating and/or air conditioning system to flow within the enclosed space and either leave through openings in the enclosed space, such as air leaks, open doors or windows, chimneys and air exhaust systems, or return to the cold air return; which ventilation system further comprises a pressure differential monitoring sensor, which pressure differential monitoring sensor monitors the air pressure inside the enclosed space and also monitors soil gas pressure beneath the foundation or floor of the lowest occupied level of the enclosed space, for use as a reference, without significantly altering said soil gas pressure; which pressure differential monitoring sensor produces a signal in response to the difference between the two identified pressures, which signal is used to regulate the operation of the fresh air supply device so as to increase inlet fresh air volume inflow rate when the air pressure in the enclosed space is at a level, when compared to the soil gas pressure, lower than a user selected level, so that the air pressure inside the enclosed space is increased, and to otherwise cause operation at a user selected minimum inlet fresh air volume inflow rate sufficient to maintain a healthy air quality environment inside the enclosed space.

2. A ventilation system as in claim 1 in which the heating and/or air conditioning blower fan may be set to continually operate so that a constant minimum volume of recirculating air flow and constant air filtration will occur within the enclosed space but which allows the heating and/or air conditioning blower fan to operate at a higher rate during operation of the heating and/or cooling systems.

3. An enclosed space, as in claim 2, in which the common duct further comprises a portion thereof which opens directly into the enclosed space.

4. An enclosed space as in claim 2 in which the signal is also used to control an air exhaust device.

5. An enclosed space which is equipped with a heating and/or air conditioning system comprised of a cold air return, a blower fan and an air filter; which enclosed space also includes a ventilation system, which ventilation system comprises, in combination with the heating and/or air conditioning system, a series combination of an air prefilter and a fresh air supply device, which air prefilter and fresh air supply device are attached to one another by way of a common duct, which common duct, at one end thereof, has access to the atmosphere outside the enclosed space, and which common duct, at the other end thereof, attaches to and opens into the cold air return of the heating and/or air conditioning system of the enclosed space; which enclosed space heating and/or air conditioning system is fashioned such that essentially all air entering the cold air return passes through the air filter and is caused by the blower fan of the heating and/or air conditioning system to flow within the enclosed space and either leave through openings in the enclosed space, such as air leaks, open doors or windows, chimneys and air exhaust systems, or return to the cold air return; which ventilation system further comprises a pressure differential monitoring sensor, which pressure differential monitoring sensor monitors the air pressure inside the enclosed space and also monitors soil gas pressure beneath the foundation or floor of the lowest occupied level of the enclosed space, for use as a reference, without significantly altering said soil gas pressure; which pressure differential monitoring sensor produces a signal in response to the difference between the two identified pressures, which signal is used to regulate the operation of the fresh air supply device so as to increase inlet fresh air volume inflow rate whenever the air pressure in the enclosed space is at a level, when compared to the soil gas pressure, lower than a user selected level, so that the air pressure inside the enclosed space is increased, and to otherwise cause operation at a user selected minimum inlet fresh air volume inflow rate sufficient to maintain a healthy air quality environment inside the enclosed space.

6. An enclosed space as in claim 5 in which the heating and/or air conditioning blower fan may be set to continually operate so that a constant minimum rate of air recirculation occurs within the enclosed space, and which allows the heating and/or air conditioning blower fan to operate at a higher rate during operation of the heating and/or cooling systems.

7. A method of economically ventilating an enclosed space to provide a healthy environment therein comprising the steps of:

a. fitting the enclosed space, which enclosed space is equipped with a heating and/or air conditioning system comprised of a cold air return, a blower fan and an air filter; with a ventilation system, which ventilation system comprises, in combination with the heating and/or air conditioning system, a series combination of an air prefilter and a fresh air supply device, which air prefilter and fresh air supply device are attached to one another by way of a common duct, which common duct, at one end thereof, has access to the atmosphere outside the enclosed space, and which common duct, at the other end thereof, attaches to, and opens into, the cold air return of the heating and/or air conditioning system of the enclosed space; which enclosed space heating and/or air conditioning system is fashioned such that essentially all air entering the cold air return passes through the air filter and is caused by the blower fan of the heating and/or air conditioning system to flow within the enclosed space and either leave through openings in the enclosed space, such as air leaks, chimneys and exhaust systems, or return to the cold air return; which ventilation system further comprises a pressure differential monitoring sensor, which pressure differential monitoring sensor monitors the air pressure inside the enclosed space and also monitors soil gas pressure beneath the foundation or floor of the lowest occupied level of the enclosed space without significantly altering said soil gas pressure; which pressure differential monitoring sensor produces a signal in response to the difference between the two identified pressures, which signal is used to regulate the operation of the fresh air supply device so as to increase inlet fresh air volume inflow rate when the air pressure in the enclosed space is at a level, when compared to the soil gas pressure, lower than a user selected level, so that the air pressure inside the enclosed space is increased, and to otherwise cause operation at a user selected minimum inlet fresh air volume inflow rate sufficient to maintain a healthy air quality environment inside the enclosed space;

b. setting the heating and/or air conditioning system blower fan to continually operate so that a minimum rate of recirculating air flow and constant air filtration will occur in the enclosed space, but allowing the heating and/or air conditioning blower fan to operate at a higher rate during operation of heating and/or cooling systems;

c. setting the pressure differential monitoring sensor, the signal developed thereby which acts to control the fresh air supply device, so that the fresh air supply device operates at a user selected level to cause some minimum level of inlet fresh air volume inflow rate from the outside of the enclosed space to be continually entered into the cold air return of the heating and/or air conditioning system of the enclosed space, which level of inlet air volume inflow rate is sufficient to maintain a healthy air quality environment inside the enclosed space;

d. allowing the ventilation system to operate so that when air inside the enclosed space is expelled through air leaks, chimneys or exhaust fans etc., the fresh air supply device is caused, by a change in the signal from the pressure differential monitor sensor, to operate so as to cause an increased volume of fresh air to flow into the cold air return of the heating and/or air conditioning system and thereby reestablish the relationship between the air pressure inside the enclosed space and the soil gas pressure which was set in step c above, until said increased volume of fresh air inflow is no longer required to maintain the identified relationship between air pressure inside the enclosed space and the soil gas pressure, at which time the fresh air supply device is caused to operate so as to provide the minimum inlet fresh air volume inflow rate sufficient to maintain a healthy air quality environment inside the enclosed space.

8. A ventilation system for use in an enclosed space, which ventilation system comprises a series combination of an air prefilter and fresh air supply device, which air prefilter and fresh air supply device are attached to one another by way of a common duct, which common duct, at one end thereof, has access to the atmosphere outside the enclosed space, and which common duct, at the other end thereof opens into the enclosed space and provides fresh air thereto, which fresh air leaves through openings in the enclosed space, such as air leaks, open doors or windows, chimneys and air exhaust systems; which ventilation system further comprises a pressure differential monitoring sensor, which pressure differential monitoring sensor monitors the air pressure inside the enclosed space and also monitors soil gas pressure beneath the foundation or floor of the lowest occupied level of the enclosed space, for use as a reference, without significantly altering said soil gas pressure; which pressure differential monitoring sensor produces a signal in response to the difference between the two identified pressures, which signal is used to regulate the operation of the fresh air supply device so as to increase inlet fresh air volume inflow rate when the air pressure in the enclosed space is at a level, when compared to the soil gas pressure, lower than a user selected level, so that the air pressure inside the enclosed space is increased, and to otherwise cause operation at a user selected minimum inlet fresh air volume inflow rate sufficient to maintain a healthy air quality environment inside the enclosed space.

9. An enclosed space, as in claim 8, which further comprises a heating and/or air conditioning system and in which the common duct opens into the enclosed space at a level which is different from that on which the heating and/or air conditioning system is located.

10. An enclosed space, as in claim 8, which further comprises a heating and/or air conditioning system and in which the common duct opens into the enclosed space at a level which is the same as that on which the heating and/or air conditioning system is located.

11. An enclosed space as in claim 8, in which the signal is also used to control an air exhaust device.

12. An enclosed space, which enclosed space is equipped with a ventilation system, which ventilation system comprises a series combination of an air prefilter and fresh air supply device, which air prefilter and fresh air supply device are attached to one another by way of a common duct, which common duct, at one end thereof, has access to the atmosphere outside the enclosed space, and which common duct, at the other end thereof opens into the enclosed space and provides fresh air thereto, which fresh air leaves through openings in the enclosed space, such as air leaks, open doors or windows, chimneys, and air exhaust systems; which ventilation system further comprises a pressure differential monitoring sensor, which pressure differential monitoring sensor monitors the air pressure inside the enclosed space and also monitors soil gas pressure beneath the foundation or floor of the lowest occupied level of the enclosed space, for use as a reference, without significantly altering said soil gas pressure; which pressure differential monitoring sensor produces a signal in response to the difference between the two identified pressures, which signal is used to regulate the operation of the fresh air supply device so as to increase inlet fresh air volume inflow rate when the air pressure in the enclosed space is at a level, when compared to the soil gas pressure, lower than a user selected level, so that the air pressure inside the enclosed space is increased, and to otherwise cause operation at a user selected minimum inlet fresh air volume inflow rate sufficient to maintain a healthy air quality environment inside the enclosed space.

13. A method of economically ventilating an enclosed space to provide a healthy air quality environment therein comprising the steps of:

a. fitting the enclosed space with a ventilation system, which ventilation system comprises a series combination of an air prefilter and fresh air supply device, which air prefilter and fresh air supply device are attached to one another by way of a common duct, which common duct, at one end thereof, has access to the atmosphere outside the enclosed space, and which common duct, at the other end thereof opens into the enclosed space and provides fresh air thereto, which fresh air leaves through openings in the enclosed space, such as air leaks, open doors or windows, chimneys and air exhaust systems; which ventilation system further comprises a pressure differential monitoring sensor, which pressure differential monitoring sensor monitors the air pressure inside the enclosed space and also monitors soil gas pressure beneath the foundation or floor of the lowest occupied level of the enclosed space, for use as a reference, without significantly altering said soil gas pressure; which pressure differential monitoring sensor produces a signal in response to the difference between the two identified pressures, which signal is used to regulate the operation of the fresh air supply device so as to increase inlet fresh air volume inflow rate when the air pressure in the enclosed space is at a level, when compared to the soil gas pressure, lower than a user selected level, so that the air pressure inside the enclosed space is increased, and to otherwise cause operation at a user selected minimum inlet fresh air volume inflow rate sufficient to maintain a healthy air quality environment inside the enclosed space;

b. setting the pressure differential monitoring sensor, the signal developed thereby which acts to control the fresh air supply device, so that the fresh air supply device operates at some user selected level to cause some minimum level of fresh air volume rate from the outside of the enclosed space to be continually entered into the enclosed space, which level of inlet air volume inflow rate is sufficient to maintain a healthy air quality environment inside the enclosed space;

c. allowing the ventilation system to operate so that when air inside the enclosed space is expelled through air leaks, chimneys or exhaust fans etc. the fresh air supply device is caused, by a change in the signal from the pressure differential monitoring sensor, to operate so as to cause an increased volume of inlet fresh air to flow into the enclosed space and thereby reestablish the relationship between the air pressure inside the enclosed space and the soil gas pressure which was set in step b above, until said increased volume of inlet fresh air inflow is no longer required to maintain the identified relationship between air pressure inside the enclosed space and the soil gas pressure, at which time the fresh air supply device is again caused by the signal from the pressure differential monitoring sensor to operate so as to provide the minimum inlet fresh air volume inflow rate sufficient to maintain a healthy air quality environment inside the enclosed space.

14. A ventilation system for use in an enclosed space, which ventilation system comprises a fresh air supply device, which fresh air supply device is attached to a duct, which duct, at one end thereof, has access to the atmosphere outside the enclosed space, and which duct, at the other end thereof opens into the enclosed space and provides fresh air thereto, which fresh air leaves through openings in the enclosed space, such as air leaks, open doors or windows, chimneys and air exhaust systems; which ventilation system further comprises a pressure differential monitoring sensor, which pressure differential monitoring sensor monitors the air pressure inside the enclosed space and also monitors soil gas pressure beneath the foundation or floor of the lowest occupied level of the enclosed space, for use as a reference, without significantly altering said soil gas pressure; which pressure differential monitoring sensor produces a signal in response to the difference between the two identified pressures, which signal is used to regulate the operation of the fresh air supply device so as to increase inlet fresh air volume inflow rate when the air pressure in the enclosed space is at a level, when compared to the soil gas pressure, lower than a user selected level, so that the air pressure inside the enclosed space is increased, and to otherwise operate at a user selected minimum inlet fresh air volume inflow rate sufficient to maintain a healthy air quality environment inside the enclosed space.

15. An enclosed space, which enclosed space is equipped with a ventilation system, which ventilation system comprises a fresh air supply device, which fresh air supply device is attached to a duct, which duct, at one end thereof, has access to the atmosphere outside the enclosed space, and which duct, at the other end thereof opens into the enclosed space and provides fresh air thereto, which fresh air leaves through openings in the enclosed space, such as air leaks, open doors or windows, chimneys and air exhaust systems; which ventilation system further comprises a pressure differential monitoring sensor, which pressure differential monitoring sensor monitors the air pressure inside the enclosed space and also monitors soil gas pressure beneath the foundation or floor of the lowest occupied level of the enclosed space, for use as a reference, without significantly altering said soil gas pressure; which pressure differencial monitoring sensor produces a signal in response to the difference between the two identified pressures, which signal is used to regulate the operation of the fresh air supply device so as to increase inlet fresh air volume inflow rate when the air pressure in the enclosed space is at a level, when compared to the soil gas pressure, lower than a user selected level, so that the air pressure inside the enclosed space is increased, and to otherwise operate at a user selected minimum fresh air volume inflow rate sufficient to maintain a healthy environment inside the enclosed space.

16. An enclosed space as in claim 15, which enclosed space further comprises a heating and/or air conditioning system, which heating and/or air conditioning system contains a cold air return, which duct further comprises a portion thereof which attaches to and opens into the cold air return in the enclosed space.

17. An enclosed space as in claim 15 in which the signal is also used to control an air exhaust device.

18. A method of economically ventilating an enclosed space to provide a healthy air quality environment therein comprising the steps of:

a. fitting the enclosed space with a ventilation system, which ventilation system comprises a fresh air supply device, which fresh air supply device is attached to a duct, which duct, at one end thereof, has access to the atmosphere outside the enclosed space, and which duct, at the other end thereof opens into the enclosed space and provides fresh air thereto, which fresh air leaves through openings in the enclosed space, such as air leaks, open doors or windows, chimneys and air exhaust systems; which ventilation system further comprises a pressure differential monitoring sensor, which pressure differential monitoring sensor monitors the air pressure inside the enclosed space and also monitors soil gas pressure beneath the foundation or floor of the lowest occupied level of the enclosed space, for use as a reference, without significantly altering said soil gas pressure; which pressure differential monitoring sensor produces a signal in response to the difference between the two identified pressures, which signal is used to regulate the operation of the fresh air supply device so as to increase inlet fresh air volume inflow rate when the air pressure in the enclosed space is at a level, when compared to the soil gas pressure, lower than a user selected level, so that the air pressure inside the enclosed space is increased, and to otherwise operate at a user selected minimum inlet fresh air volume inflow rate sufficient to maintain a healthy air quality environment inside the enclosed space;

b. setting the pressure differential monitoring sensor, the signal developed thereby which acts to control the fresh air supply device, so that the fresh air supply device operates at some user selected level to cause some minimum level of inlet fresh air volume inflow from the outside of the enclosed space to be continually entered into the enclosed space, which level of inlet fresh air volume inflow is sufficient to maintain a healthy air quality environment inside the enclosed space;

c. allowing the ventilation system to operate so that when air inside the enclosed space is expelled through air leaks, chimneys or exhaust fans etc. the fresh air supply device is caused, by a change in the signal from the pressure differential monitoring sensor, to operate so as to cause an increased volume of fresh air to flow into the enclosed space and thereby reestablish the relationship between the air pressure inside the enclosed space and the soil gas pressure which was set in step b above, until said increased volume of fresh air inflow is no longer required to maintain the identified relationship between air pressure inside the enclosed space and the soil gas pressure, at which time the fresh air supply device is again caused to operate at a user selected minimum inlet fresh air volume inflow rate so as to maintain a healthy air quality environment inside the enclosed space.

19. An enclosed space, which enclosed space is equipped with a ventilation system, which ventilation system comprises a fresh air supply device, which fresh air supply device is attached to a duct, which duct, at one end thereof, has access to the atmosphere outside the enclosed space, and which duct, at the other end thereof opens into the enclosed space and provides fresh air thereto, which fresh air leaves through openings in the enclosed space, such as air leaks, open doors or windows, chimneys and air exhaust device, which air exhaust device is attached to a second duct at one end of thereof, which second duct has access to the outside atmosphere at an opposite end thereof; which fresh air supply device can be set to operate at an inlet fresh air volume inflow rate by a user; which ventilation system further comprises a pressure differential monitoring sensor, which pressure differential monitoring sensor monitors the air pressure inside the enclosed space and also monitors soil gas pressure beneath the foundation or floor of the lowest occupied level of the enclosed space, for use as a reference, without significantly altering said soil gas pressure; which pressure differential monitoring sensor produces a signal in response to the difference between the two identified pressures, which signal is used to regulate the operation of the air exhaust device so as to increase exhaust air volume outflow rate when the air pressure in the enclosed space is at a level, when compared to the soil gas pressure, higher than a user selected level, so that the air pressure inside the enclosed space is decreased, and to otherwise operate at a user selected minimum exhaust air volume outflow rate sufficient to maintain a healthy air quality environment inside the enclosed space.

20. An enclosed space as in claim 19, which enclosed space further comprises a heating and/or air conditioning system, which heating and/or air conditioning system contains a cold air return, which duct further comprises a portion thereof which attaches to and opens into the cold air return in the enclosed space.

21. An enclosed space as in claim 19, which enclosed space further comprises an air prefilter commonly in the duct with the fresh air supply device.

* * * * *